US011859897B2

(12) United States Patent
Liu et al.

(10) Patent No.: US 11,859,897 B2
(45) Date of Patent: Jan. 2, 2024

(54) CLIP ASSEMBLY AND REFRIGERATING AND FREEZING DEVICE WITH SAME

(71) Applicants: QINGDAO HAIER REFRIGERATOR CO., LTD., Shandong (CN); HAIER SMART HOME CO., LTD., Shandong (CN)

(72) Inventors: Wenlong Liu, Qingdao (CN); Weijian Fu, Qingdao (CN); Guangrui Wu, Qingdao (CN); Liwen Yang, Qingdao (CN); Haidong Tang, Qingdao (CN)

(73) Assignees: QINGDAO HAIER REFRIGERATOR CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 18/042,898

(22) PCT Filed: Aug. 4, 2021

(86) PCT No.: PCT/CN2021/110592
§ 371 (c)(1),
(2) Date: Feb. 24, 2023

(87) PCT Pub. No.: WO2022/042243
PCT Pub. Date: Mar. 3, 2022

(65) Prior Publication Data

US 2023/0251028 A1 Aug. 10, 2023

(30) Foreign Application Priority Data

Aug. 24, 2020 (CN) ..... 202010857998.2

(51) Int. Cl.
*F25D 23/12* (2006.01)
*F25D 23/02* (2006.01)

(52) U.S. Cl.
CPC ..... *F25D 23/12* (2013.01); *F25D 23/028* (2013.01)

(58) Field of Classification Search
CPC ..... F25D 23/12; F25D 23/04
See application file for complete search history.

(56) References Cited

U.S. PATENT DOCUMENTS 7,092,988 B1 * 8/2006 Bogatin ..... H04L 67/025 700/211
7,520,758 B2 4/2009 Kim
(Continued)

FOREIGN PATENT DOCUMENTS

CN 101182966 A 5/2008
CN 102374745 A 3/2012
(Continued)

OTHER PUBLICATIONS

International Search Report and Written Opinion for PCT/CN2021/110592 (ISA/CN) dated Nov. 11, 2021 (13 pages).

*Primary Examiner* — Filip Zec
(74) *Attorney, Agent, or Firm* — ALSTON & BIRD LLP

(57) ABSTRACT

Provided are a clip assembly and a refrigerating and freezing device provided with same, wherein the clip assembly comprises a fixed member used for fixing to the refrigerating and freezing device, clips, a clip storage box, and a movable member. The clip storage box has a storage cavity used for storing the clips. The clips may be stored and organized, and are convenient for users to access. Moreover, the movable member has an accommodating space that accommodates the clip storage box. The clip storage box is detachably accommodated in the accommodating space, and the movable member is configured to operably rotate to the side away from the fixed member, which facilitates the removal
(Continued)

of the clip storage box from the movable member, and then the clip storage box can be cleaned.

8 Claims, 7 Drawing Sheets

(56) References Cited

U.S. PATENT DOCUMENTS

| | | | | |
|---|---|---|---|---|
| 7,651,368 | B2 * | 1/2010 | Kendall | H01R 31/06 439/527 |
| 8,040,666 | B2 * | 10/2011 | McCoy | F25D 23/126 361/679.01 |
| 8,700,809 | B2 * | 4/2014 | Ferragut, II | F24C 7/082 710/8 |

FOREIGN PATENT DOCUMENTS

| | | | | | |
|---|---|---|---|---|---|
| CN | 103471311 | A | | 12/2013 | |
| CN | 104534798 | A | | 4/2015 | |
| CN | 205708041 | U | | 11/2016 | |
| CN | 109869975 | A | | 6/2019 | |
| CN | 110796215 | A | | 2/2020 | |
| CN | 212378351 | U | | 1/2021 | |
| IT | 0911592 | A2 | * | 4/1998 | F25D 23/12 |
| WO | WO-2009077351 | A2 | * | 6/2009 | F25D 23/04 |
| WO | WO-2011018350 | A1 | * | 2/2011 | A47B 88/00 |

* cited by examiner

CLIP ASSEMBLY AND REFRIGERATING AND FREEZING DEVICE WITH SAME

CROSS-REFERENCE TO RELATED APPLICATIONS

The present application is a national phase entry of International Application No. PCT/CN2021/110592, filed Aug. 4, 2021, which claims priority to Chinese Application No. 202010857998.2, filed Aug. 24, 2020, which are each incorporated herein by reference in its entirety.

FIELD OF THE INVENTION

The present invention relates to the field of refrigerating and freezing storage technologies, and particularly to a clip assembly and a refrigerating and freezing device with same.

BACKGROUND OF THE INVENTION

In order to seal unsealed food or mark food, clips are generally provided in an existing refrigerating and freezing device, for example, a refrigerator, and a user can seal outer packing of the food or mark the food using the clips as required.

The existing clips are generally exposed in the refrigerator, condensation is prone to being formed on the clips, and the clips are arranged disorderly to influence access.

BRIEF DESCRIPTION OF THE INVENTION

An object of the present invention is to provide a clip assembly and a refrigerating and freezing device with same, which solve at least the above problem.

A further object of the present invention is to provide a clip assembly which can be used as an electronic tag to realize intelligent management of food in a refrigerating and freezing device.

According to an aspect of the present invention, the present invention first provides a clip assembly arranged in a refrigerating and freezing device, the clip assembly comprising:

a fixed member used for fixing to the refrigerating and freezing device; and clips, a clip storage box, and a movable member, wherein the clip storage box has a storage cavity used for storing the clips, the movable member has an accommodating space that accommodates the clip storage box, the clip storage box is detachably accommodated in the accommodating space, and the movable member is configured to operably rotate to a side away from the fixed member, such that the clip storage box can be taken out for cleaning.

Optionally, the fixed member includes a fixed vertical plate and two fixed side plates extending backwards from two sides of the fixed vertical plate in a length direction thereof respectively, and each of the fixed side plates is provided with a slide way and a rotary shaft hole;

the movable member includes a movable vertical plate and two movable side plates extending backwards from two sides of the movable vertical plate in a length direction thereof respectively, and each of the movable side plates is provided with a positioning shaft fitted with the slide way and a rotary shaft fitted with the rotary shaft hole; and the movable member is configured to rotate with the rotary shaft as an axis when operably rotating to the side away from the fixed member, and the positioning shaft moves along the slide way.

Optionally, each of the movable side plates is further provided with an opening and a flexible limiting member located in the opening, and the flexible limiting member has a fixed part connected to an upper end of the opening and a free part extending downwards from the fixed part;

a limiting fitting member is formed at a position of the clip storage box corresponding to the flexible limiting member, the flexible limiting member is exposed after the movable member rotates to the side away from the fixed member, and the free part of the flexible limiting member operably moves away from the limiting fitting member to be separated from the limiting fitting member, such that the clip storage box is operably taken out.

Optionally, the movable member further includes a bottom plate extending backwards from a lower end of the movable vertical plate, and a rear vertical plate located on a rear side of the movable vertical plate, and the movable vertical plate, the bottom plate, the two movable side plates, and the rear vertical plate define the accommodating space; and the rear vertical plate is clamped to the bottom plate and the two movable side plates.

Optionally, an upper flange smoothly bent and extending forwards and upwards is formed at an upper end of the movable vertical plate, a first positioning plate extending along the length direction of the upper flange and extending backwards is formed on a rear side of the upper flange, and the first positioning plate is located above the movable vertical plate and spaced apart from the upper end of the movable vertical plate;

a second positioning plate extending along the length direction of the rear vertical plate and extending forwards is formed on a front side surface of the rear vertical plate;

the first positioning plate is provided with a plurality of first positioning holes distributed at intervals along the length direction of the first positioning plate, and the second positioning plate is provided with a plurality of second positioning holes distributed at intervals along the length direction of the second positioning plate;

the clip storage box includes a box body, a front flange extending forwards from a front edge of an upper end portion of the box body, and a rear flange extending backwards from a rear edge of the upper end portion of the box body, a plurality of first positioning parts which extend downwards and are in one-to-one correspondence with and fitted with the plurality of first positioning holes are formed on a lower side of the front flange, and a plurality of second positioning parts which extend downwards and are in one-to-one correspondence with and fitted with the plurality of second positioning holes are formed on a lower side of the rear flange.

Optionally, a lower flange extending downwards is formed on a rear side of the bottom plate, a side flange extending outwards along the length direction of the movable side plate is formed on a rear side of each movable side plate, a plurality of first clamping holes distributed at intervals along the length direction of the lower flange are formed in the lower flange, and a second clamping hole is formed in a lower end of the side flange; and the rear vertical plate is provided with a plurality of first buckles in one-to-one correspondence with the plurality of first clamping holes and clamped thereto, and a second buckle clamped to the second clamping hole.

Optionally, a first positioning groove is formed in an upper end of the side flange, and a positioning strip located between the first positioning groove and the second clamping hole and protruding backwards is further formed on the side flange; and the rear vertical plate is further provided with a positioning post fitted with the first positioning groove and extending forwards, and a second positioning groove fitted with the positioning strip.

Optionally, the clip assembly further includes:

an antenna board cover having a vertical plate cover located between the fixed vertical plate and the movable vertical plate and a lower mounting plate extending backwards from a lower end of the vertical plate cover to a position below the bottom plate of the movable member;

chips in one-to-one correspondence with the clips, the chips having food information, and the chips being configured to be operably taken out;

an antenna board arranged on the vertical plate cover and located on a rear side of the vertical plate cover; and a control board arranged on the lower mounting plate and covered with the bottom plate, the control board being configured to read the food information on the chips through the antenna board.

Optionally, the number of the clips is multiple, the number of the chips is multiple, the chips are in one-to-one correspondence with the clips, and the food information contained in the chips is different;

the clip storage box has a plurality of storage cavities in one-to-one correspondence with the clips, a clip taking opening is formed in an upper end of each storage cavity, and the clips are inserted into the corresponding storage cavities or extracted from the corresponding storage cavities through the clip taking openings.

Optionally, a plurality of first clamping hooks distributed at intervals in the length direction of the vertical plate cover are formed on a rear side of an upper end portion of the vertical plate cover, a plurality of second clamping hooks distributed at intervals in the length direction of the vertical plate cover are formed on a rear side of a lower end portion of the vertical plate cover, and the plurality of second clamping hooks have the same number as the plurality of first clamping hooks and are in one-to-one correspondence with the plurality of first clamping hooks;

the antenna board is clamped between the plurality of first clamping hooks and the plurality of second clamping hooks;

a first clamping protrusion protruding backwards is formed on a rear side surface of the antenna board, and a first clamping groove fitted with the first clamping protrusion is formed in a front side surface of the movable vertical plate;

a plurality of second clamping grooves distributed at intervals along the length direction of the vertical plate cover are formed in an upper side of the upper end portion of the vertical plate cover, and a plurality of second clamping protrusions which are in one-to-one correspondence with the plurality of second clamping grooves and clamped thereto are further formed on the front side surface of the movable vertical plate.

According to another aspect of the present invention, the present invention further provides a refrigerating and freezing device, including:

a door body; and the clip assembly according to any one of the foregoing descriptions, wherein the fixed member of the clip assembly is connected to an inner side of the door body.

In the clip assembly and the refrigerating and freezing device according to the present invention, the clip storage box is additionally arranged, such that the clips can be stored and organized and are convenient for users to access; the clip storage box is provided with a placing space by additionally arranging the movable member, thus avoiding condensation of the clips and the clip storage box; in addition, the movable member is rotatably arranged, which facilitates the removal of the clip storage box from the movable member, and then, the clip storage box can be cleaned.

Further, in the clip assembly and the refrigerating and freezing device according to the present invention, the clips can be used as electronic tags, and the clips are used for dynamically monitoring the food in the refrigerating and freezing device, such that the food is intelligently managed to improve the intelligence of the refrigerating and freezing device.

Still further, in the clip assembly and the refrigerating and freezing device according to the present invention, the fixed member, the movable member, the clip storage box and the antenna board are specially designed, such that stable assembly of components is guaranteed, an overall design is ingenious, a structure is compact, and an occupied space is small.

According to the following detailed description of specific embodiments of the present invention in conjunction with drawings, those skilled in the art will better understand the aforementioned and other objects, advantages and features of the present invention.

BRIEF DESCRIPTION OF THE DRAWINGS

Some specific embodiments of the present invention will be described below in detail in an exemplary rather than restrictive manner with reference to the drawings. Identical reference numerals in the drawings represent identical or similar components or parts. Those skilled in the art should understand that these drawings are not necessarily drawn to scale. In the drawings.

DETAILED DESCRIPTION

Embodiments provide a clip assembly 100 and a refrigerating and freezing device with same, and the refrigerating and freezing device can be a device with refrigerating and freezing functions, such as a refrigerator, a freezer, or the like. The clip assembly 100 and the refrigerating and freezing device according to the embodiments will be described in detail below with reference to FIGS. 1 to 8.

Figure 1:
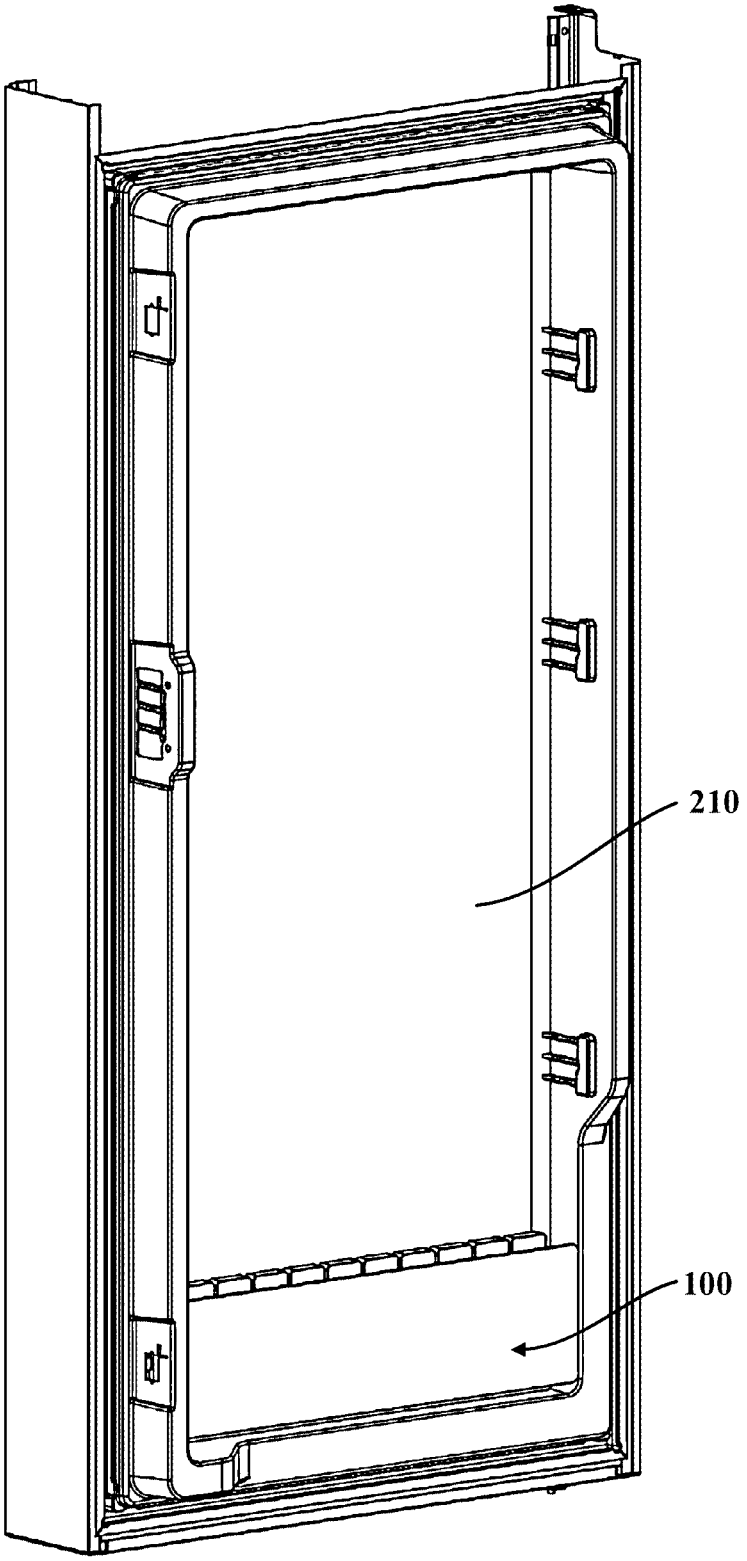
FIG. 1 is a schematic diagram of a combined structure of a door body and a clip assembly of a refrigerating and freezing device according to an embodiment of the present invention.
Figure 2:
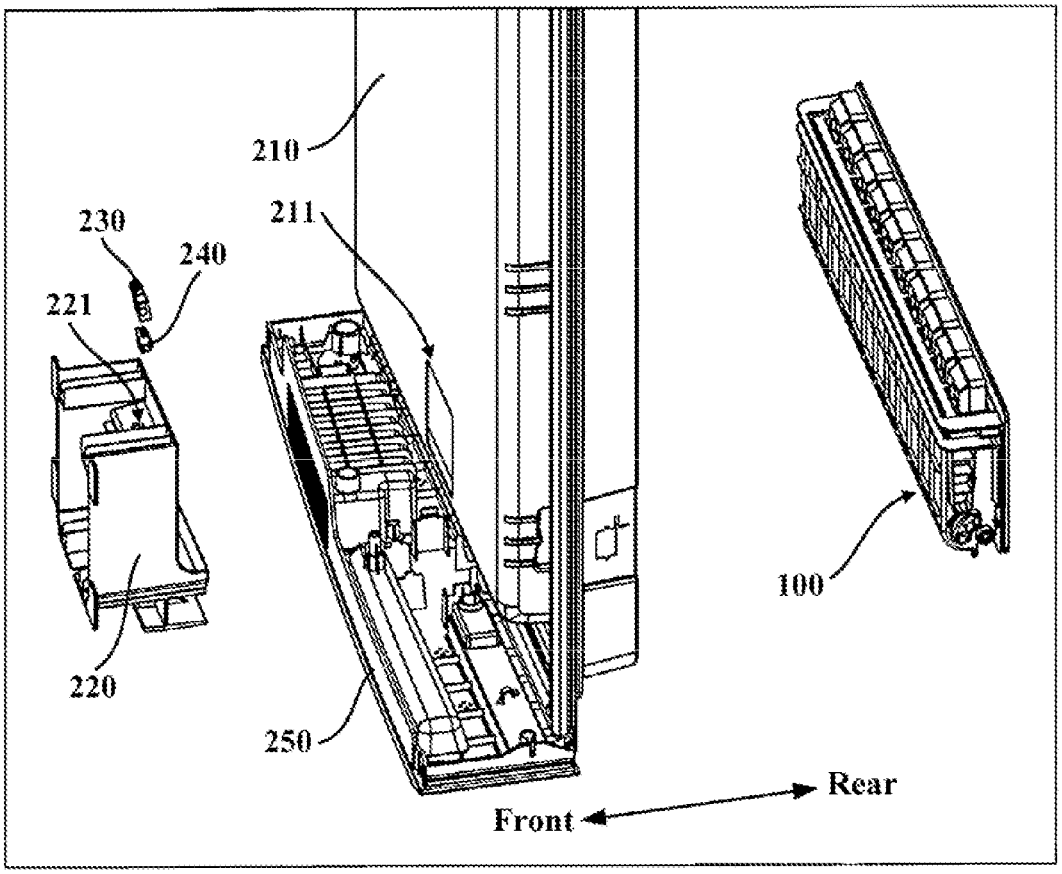
FIG. 2 is a schematic partial exploded structural diagram of a refrigerating and freezing device according to an embodiment of the present invention.
Figure 3:
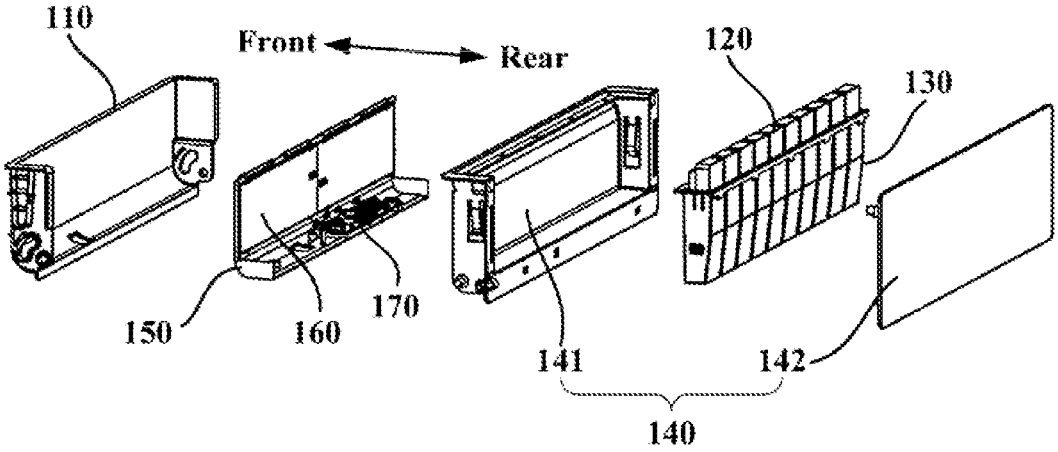
FIG. 3 is a schematic exploded structural diagram of a clip assembly according to an embodiment of the present invention.
Figure 4:
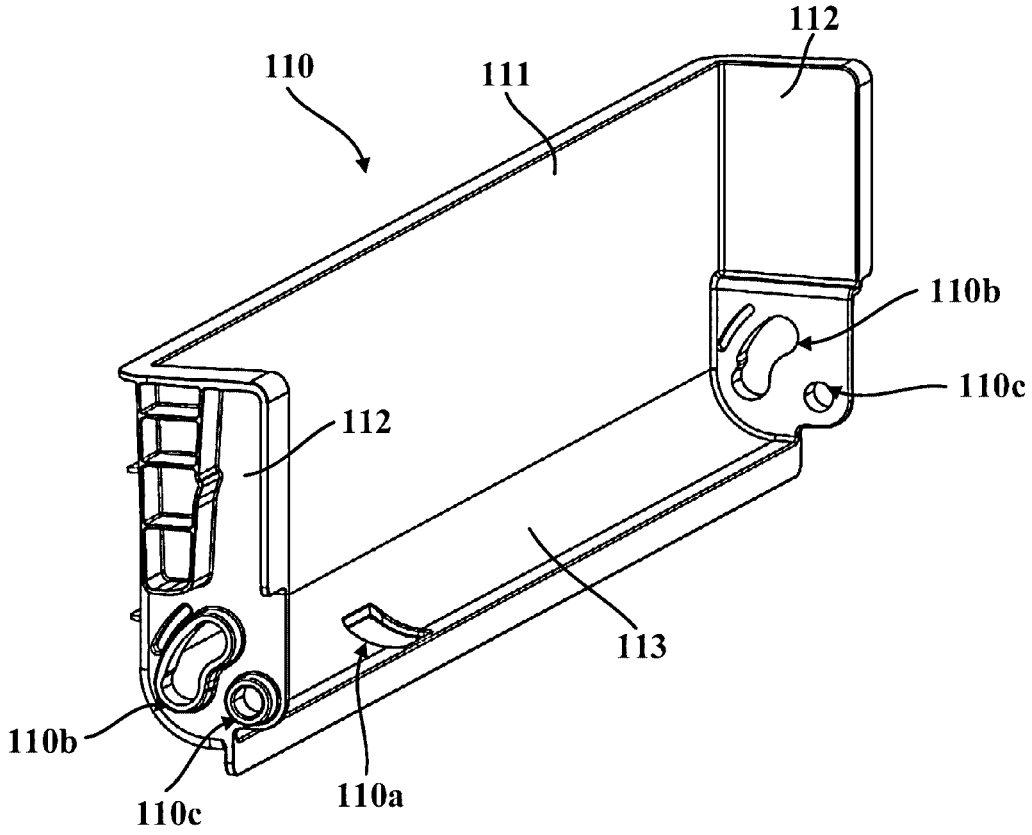
FIG. 4 is a schematic structural diagram of a fixed member of a clip assembly according to an embodiment of the present invention.
Figure 5:
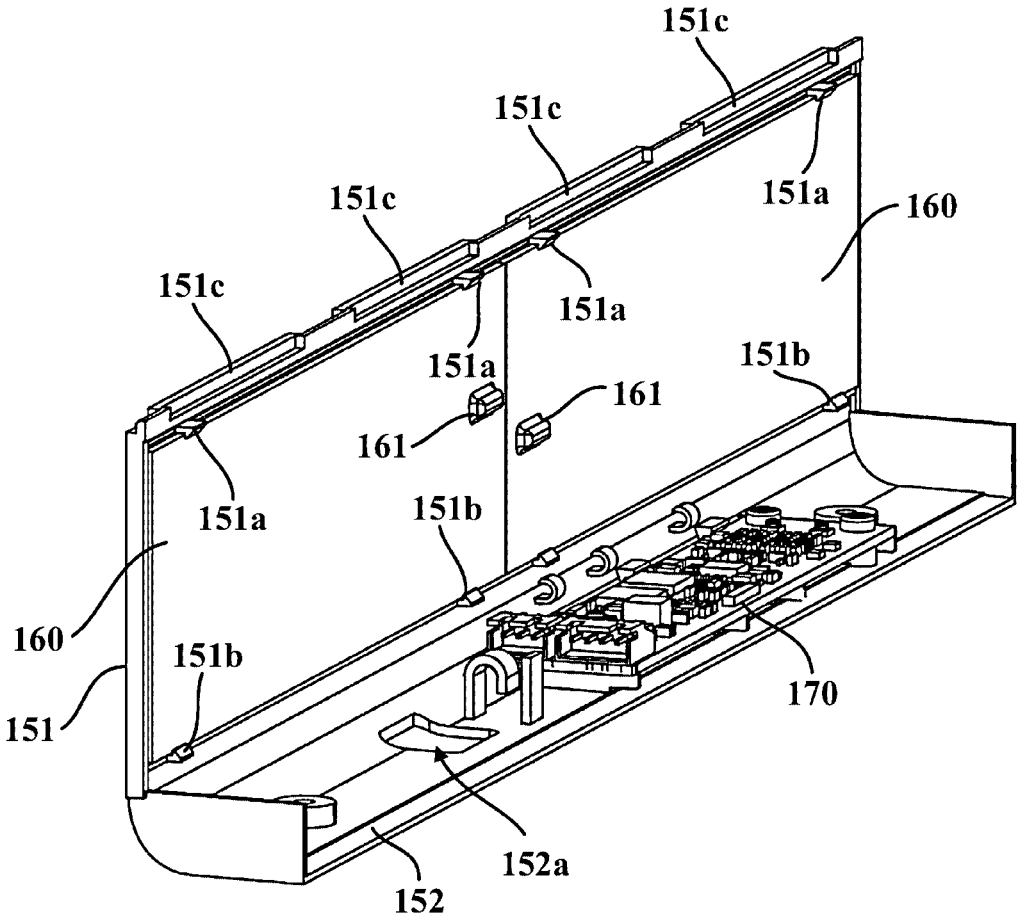
FIG. 5 is a schematic diagram of a combined structure of an antenna board cover, an antenna board and a control board of a clip assembly according to an embodiment of the present invention.
Figure 6:
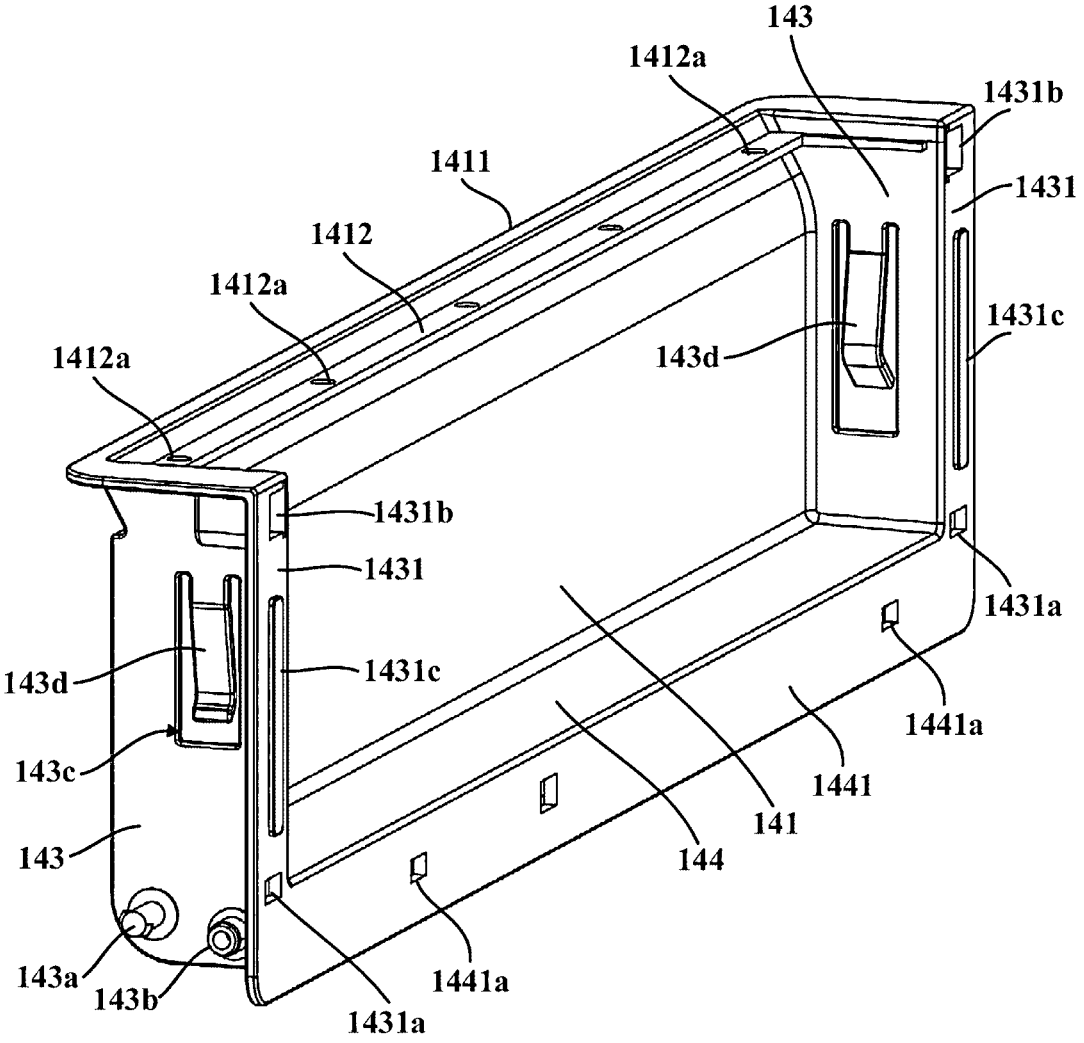
FIG. 6 is a schematic partial structural diagram of a movable member of a clip assembly according to an embodiment of the present invention.
Figure 7:
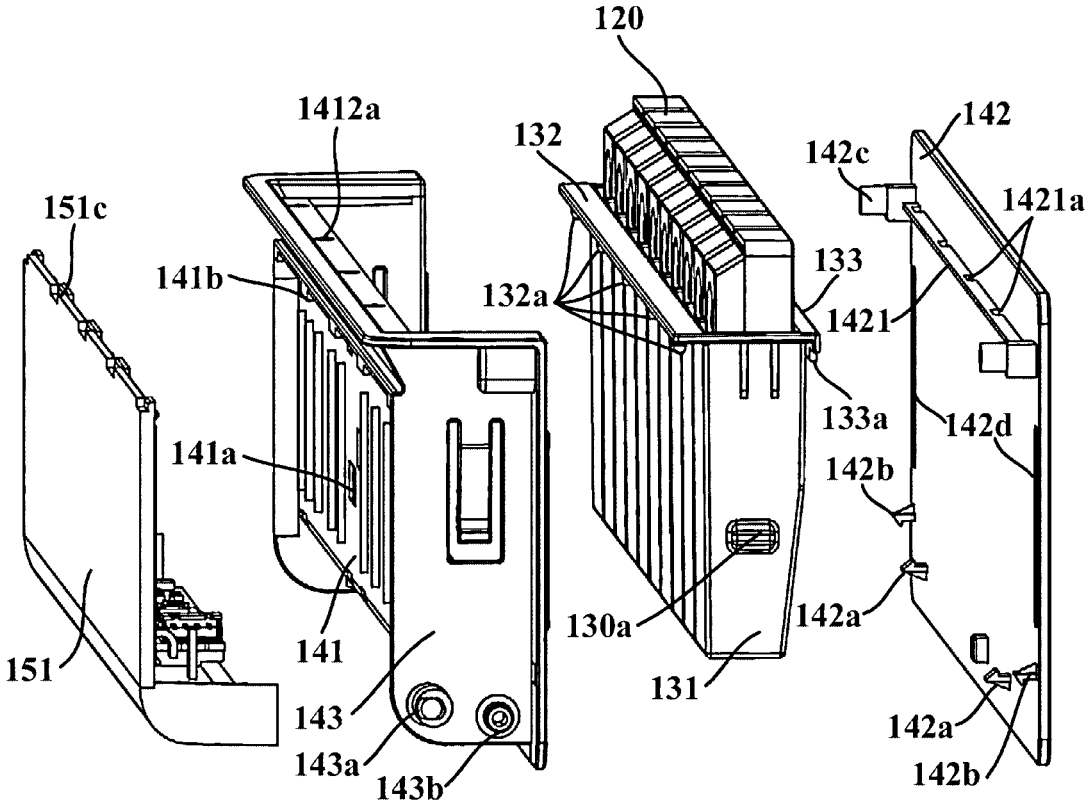
FIG. 7 is a schematic partial exploded structural diagram of a clip assembly according to an embodiment of the present invention.
Figure 8:
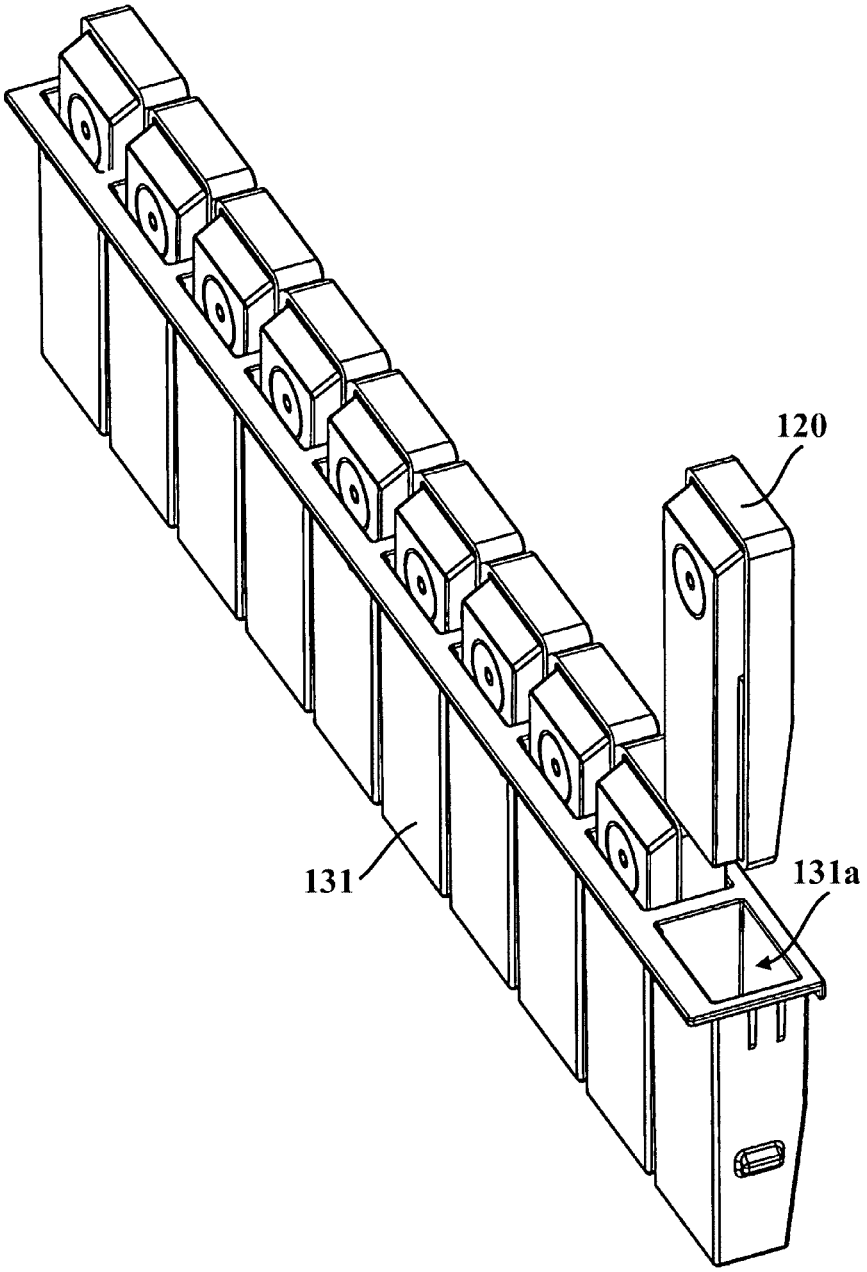
FIG. 8 is a schematic diagram of a combined structure of a clip storage box and clips of a clip assembly according to an embodiment of the present invention.

As shown in FIGS. 1 and 2, the clip assembly 100 is arranged on an inner side of a door body 210 of the refrigerating and freezing device, and is convenient for a user to access.

Specifically, as shown in FIGS. 3 to 8, the clip assembly 100 includes a fixed member 110, and the fixed member 110 is fixed to the door body 210 of the refrigerating and freezing device, such that the clip assembly 100 is integrally assembled on the inner side of the door body 210. The clip assembly 100 further includes clips 120, a clip storage box 130, and a movable member 140, the clip storage box 130 has a storage cavity 131*a* used for storing the clips 120, the movable member 140 has an accommodating space that accommodates the clip storage box 130, the clip storage box 130 is detachably accommodated in the accommodating space, and the movable member 140 is configured to operably rotate to a side away from the fixed member 110, such that the clip storage box 130 can be taken out for cleaning.

In the present embodiment, the clip storage box 130 is additionally arranged, such that the clips 120 can be stored and organized and are convenient for users to access; the clip storage box 130 is provided with a placing space by additionally arranging the movable member 140, thus avoiding condensation of the clips 120 and the clip storage box 130; in addition, the movable member 140 is rotatably arranged, which facilitates the removal of the clip storage box 130 from the movable member 140, and then, the clip storage box 130 can be cleaned.

In some embodiments, the fixed member 110 includes a fixed vertical plate 111 and two fixed side plates 112 extending backwards from two sides of the fixed vertical plate 111 in a length direction of the fixed vertical plate respectively, and each of the fixed side plates 112 is provided with a slide way 110*b* and a rotary shaft hole 110*c*; the movable member 140 includes a movable vertical plate 141 and two movable side plates 143 extending backwards from two sides of the movable vertical plate 141 in a length direction of the movable vertical plate respectively, and each of the movable side plates 143 is provided with a positioning shaft 143*a* fitted with the slide way 110*b* and a rotary shaft 143*b* fitted with the rotary shaft hole 110*c*; the movable member 140 is configured to rotate with the rotary shaft 143*b* as an axis when operably rotating to the side away from the fixed member 110, and the positioning shaft 143*a* moves along the slide way 110*b*; such a design may guarantee stable rotation of the movable member 140 and facilitates user operations.

The terms "front" and "rear" in the present embodiment refer to a state after the door body 210 of the refrigerating and freezing device is closed, and when the door body 210 is closed, a side of the door body 210 facing the interior of the refrigerating and freezing device is a rear side, and a side of the door body 210 facing the user is a front side.

The movable side plate 143 may be provided with an opening 143*c* and a flexible limiting member 143*d* located in the opening 143*c*, and the flexible limiting member 143*d* has a fixed part connected to an upper end of the opening 143*c* and a free part extending downwards from the fixed part; a limiting fitting member 130*a* is formed at a position of the clip storage box 130 corresponding to the flexible limiting member 143*d*, the flexible limiting member 143*d* to may be exposed after the movable member 140 rotates to the side away from the fixed member 110, and the free part of the flexible limiting member 143*d* operably moves away from the limiting fitting member 130*a* to be separated from the limiting fitting member 130*a*.

That is, in a general state of the clip assembly 100, the flexible limiting member 143*d* of the movable member 140 is shielded by the fixed member 110, and the user cannot operate the flexible limiting member 143*d*, and due to the effects of the flexible limiting member 143*d* and the limiting fitting member 130*a* on the clip storage box 130, the clip storage box 130 cannot be taken out of the movable member 140, and when the clip storage box 130 is required to be cleaned, the user can rotate the movable member 140 to expose the flexible limiting member 143*d*, lift the free part of the flexible limiting member 143*d* away from the limiting fitting member 130*a*, so as to separate the flexible limiting member 143*d* from the limiting fitting member 130*a*, and then take out the clip storage box 130 from the movable member 140. Therefore, the stability of the clip storage box 130 and the movable member 140 is guaranteed, unstable phenomena, such as shaking, or the like, of the clip storage box 130 and the movable member 140 in the opening and closing process of the door body 210 are avoided, operations are easy, and the clip storage box 130 is convenient to take and place.

The movable member 140 may include a bottom plate 144 extending backwards from a lower end of the movable vertical plate 141, and a rear vertical plate 142 located on a rear side of the movable vertical plate 141, and the movable vertical plate 141, the bottom plate 144, the two movable side plates 143, and the rear vertical plate 142 define the accommodating space, which provides a storage space for the clip storage box 130; the rear vertical plate 142 is clamped to the bottom plate 144 and the two movable side plates 143, such that installation can be simplified, assembly is easy, and influences on an appearance caused by use of fasteners, such as screws, are avoided.

In one embodiment, a lower flange 1441 extending downwards may be formed on a rear side of the bottom plate 144, a side flange 1431 extending outwards along the length direction of the movable side plate may be formed on a rear side of each movable side plate 143, a plurality of first clamping holes 1441*a* distributed at intervals along the length direction of the lower flange are formed in the lower flange 1441, and a second clamping hole 1431*a* is formed in a lower end of the side flange 1431; the rear vertical plate 142 is provided with a plurality of first buckles 142*a* in one-to-one correspondence with the plurality of first clamping holes 1441*a* and clamped thereto, and a second buckle 142*b* clamped to the second clamping hole 1431*a*, such that the rear vertical plate 142 is clamped to the bottom plate 144 and the two movable side plates 143.

A first positioning groove 1431*b* may be formed in an upper end of the side flange 1431, and a positioning strip 1431*c* located between the first positioning groove 1431*b* and the second clamping hole 1431*a* and protruding backwards is further formed on the side flange 1431; the rear vertical plate 142 is further provided with a positioning post 142*c* fitted with the first positioning groove 1431*b* and extending forwards, and a second positioning groove 142*d* fitted with the positioning strip 1431*c*. A positioning hole or positioning groove (not numbered) located between two first clamping holes 1441*a* can be formed in the lower flange 1441, and correspondingly, a positioning protrusion (not numbered) fitted with the positioning hole or positioning groove can be formed on the rear vertical plate 142. Therefore, by the fitting of the buckles and the clamping holes and the fitting of a positioning component and the positioning groove, the assembly of the rear vertical plate 142, the bottom plate 144 and the two movable side plates 143 is simplified, and assembly stability is guaranteed.

An upper flange 1411 smoothly bent and extending forwards and upwards may be formed at an upper end of the movable vertical plate 141, a first positioning plate 1412 extending along the length direction of the upper flange and extending backwards is formed on a rear side of the upper flange 1411, and the first positioning plate 1412 is located above the movable vertical plate 141 and spaced apart from the upper end of the movable vertical plate 141; a second positioning plate 1421 extending along the length direction of the rear vertical plate and extending forwards is formed on a front side surface of the rear vertical plate 142; the first positioning plate 1412 is provided with a plurality of first positioning holes 1412*a* distributed at intervals along the length direction of the first positioning plate, and the second positioning plate 1421 is provided with a plurality of second positioning holes 1421*a* distributed at intervals along the length direction of the second positioning plate.

The clip storage box 130 includes a box body 131, a front flange 132 extending forwards from a front edge of an upper end portion of the box body 131, and a rear flange 133 extending backwards from a rear edge of the upper end portion of the box body 131, a plurality of first positioning parts 132*a* which extend downwards and are in one-to-one correspondence with and fitted with the plurality of first positioning holes 1412*a* are formed on a lower side of the front flange 132, and a plurality of second positioning parts 133*a* which extend downwards and are in one-to-one correspondence with and fitted with the plurality of second positioning holes 1421*a* are formed on a lower side of the rear flange 133, such that the placement stability of the clip storage box 130 is enhanced by the fitting of the positioning parts on the clip storage box 130 and the positioning holes in the movable vertical plate 141 and the rear vertical plate 142.

In some embodiments, the clips 120 in the clip assembly 100 can be used as ordinary clips, and the clips 120 are taken out from the clip storage box 130 for sealing unsealed outer packing of food.

In some embodiments, the clips 120 in the clip assembly 100 can be used as electronic tags, and specifically, the clip assembly 100 according to the present embodiment can further include an antenna board cover 150, chips (not shown), an antenna board 160, and a control board 170. The antenna board cover 150 has a vertical plate cover 151 located between the fixed vertical plate 111 and the movable vertical plate 141 and a lower mounting plate 152 extending backwards from a lower end of the vertical plate cover 151 to a position below the bottom plate 144 of the movable member 140; the chips are in one-to-one correspondence with the clips 120, the chips have food information, and the chips are configured to be operably taken out; the antenna board 160 is arranged on the vertical plate cover 151 and located on a rear side of the vertical plate cover 151; the control board 170 is arranged on the lower mounting plate 152 and covered with the bottom plate 144, and the control board 170 is configured to read the food information on the chips through the antenna board 160.

When storing a kind of food into the refrigerating and freezing device, the user can take out the clip 120 corresponding to the food from the clip storage box 130, place the clip and the food together, and meanwhile take out the chip corresponding to the clip 120, the control board 170 reads the removal of this chip by means of the antenna board 160, and the control board 170 records the food information corresponding to this chip, and then, the information of the food stored in the refrigerating and freezing device can be learnt. After a certain kind of food is eaten up, the clip 120 and the corresponding chip are placed at original positions again, and the control board 170 reads returning of this chip by means of the antenna board 160 to update the information of the food stored in the refrigerating and freezing device, such that the food in the refrigerating and freezing device can be dynamically monitored using the foregoing components, thereby intelligently managing the food and improving the intelligence of the refrigerating and freezing device.

The food information may include a food type, a food shelf life, or the like. When a certain kind of food is put into the refrigerating and freezing device, the user can take and use the clip 120 corresponding to the food to clip the food or outer packing of the food, and meanwhile take out the chip corresponding to the clip 120, the control board 170 reads the food type corresponding to the taken chip through the antenna board 160, and records the time of taking the chip as the initial time of putting the food into the refrigerating and freezing device, and when the shelf life of the food is about to end and the food is still not eaten up, the control board 170 sends out reminding information to remind the user that the shelf life of the food is about to expire, and the user is reminded of timely eating to avoid waste of the food.

The foregoing chip may be an NFC chip or an RFID chip, and when the chip is taken out with the corresponding clip 120, a distance between the chip and the antenna board 160 is relatively large, the control board scans the chips through the antenna board 160, and the chip which is not scanned is the taken-out chip, such that the information of the food in the refrigerating and freezing device may be updated.

One clip assembly 100 may include a plurality of clips 120, and correspondingly, the number of the chips is also multiple, the chips should be in one-to-one correspondence with the clips 120, and the food information contained in the chips is different; that is, each chip can correspond to one kind of food, the plurality of chips correspond to a plurality of different kinds of food, and the various kinds of food can be managed conveniently. Correspondingly, the clip storage box 130 has a plurality of storage cavities 131*a* in one-to-one correspondence with the clips 120, a clip taking opening is formed in an upper end of each storage cavity 131*a*, and the clips 120 are inserted into the corresponding storage cavities 131*a* or extracted from the corresponding storage cavities 131*a* through the corresponding clip taking openings, such that the clips 120 can be conveniently stored and taken out.

The chip can be arranged on an outer side or inner side of the corresponding clip 120, such that the chip can be taken and placed with the clip 120 and kept consistent with a placement position of the clip 120, thereby facilitating unified management of the chip and the clip 120.

A plurality of first clamping hooks 151*a* distributed at intervals in the length direction of to the vertical plate cover are formed on a rear side of an upper end portion of the vertical plate cover 151, a plurality of second clamping hooks 151*b* distributed at intervals in the length direction of the vertical plate cover are formed on a rear side of a lower end portion of the vertical plate cover 151, and the plurality of second clamping hooks 151*b* have the same number as the plurality of first clamping hooks 151*a* and are in one-to-one correspondence with the plurality of first clamping hooks; the antenna board 160 is clamped between the plurality of first clamping hooks 151*a* and the plurality of second clamping hooks 151*b*, such that the antenna board 160 is clamped on the vertical plate cover 151, the structure is compact, and the space is saved.

A first clamping protrusion 161 protruding backwards is formed on a rear side surface of the antenna board 160, and a first clamping groove 141*a* fitted with the first clamping protrusion 161 is formed in a front side surface of the movable vertical plate 141; a plurality of second clamping grooves 151*c* distributed at intervals along the length direction of the vertical plate cover are formed in an upper side of the upper end portion of the vertical plate cover 151, and a plurality of second clamping protrusions 141*b* which are in one-to-one correspondence with the plurality of second clamping grooves 151*c* and clamped thereto are further formed on the front side surface of the movable vertical plate 141, so as to improve the mounting stability of the antenna board 160.

In the present embodiment, the movable member 140, the clip storage box 130 and the antenna board 160 with special structures are installed and fitted, such that stable assembly of the components is guaranteed, an overall design is ingenious, the structure is compact, and the occupied space is small.

Power supply of the control board 170 can be realized by connecting a control board cable and a door body 210 cable. Specifically, the refrigerating and freezing device according to the present embodiment may further include a pre-embedded member 220, a first terminal 230 connected to the door body cable (not shown), and a second terminal 240 connected to the control board cable (not shown), the pre-embedded member 220 is arranged in a foaming layer of the door body 210, and has a first opening 221 located in an upper part and a second opening (not shown) located in a rear side in communication with the first opening 221, and the first terminal 230 passes through the first opening 221 and is connected to the second terminal 240 passing through the second opening.

A first cable passing port 211 communicated with the second opening is formed in the inner side of the door body 210, the fixed member 110 further includes a fixed lower plate 113 extending backwards from a lower side of the fixed vertical plate 111, a second cable passing port 110*a* is formed in the fixed lower plate 113, a third cable passing port 152*a* is formed in the lower mounting plate 152 of the antenna board cover 150, and the control board cable sequentially passes through the third cable passing port 152*a*, the second cable passing port 110*a* and the first cable passing port 211 and is connected with the first terminal 230 by the second terminal 240, such that the control board cable is electrically connected with the door body cable.

The door body cable generally passes through a shaft hole of an end cover 250 of the door to body 210 and a shaft hole of a hinge shaft, and then enters a cabinet of the refrigerating and freezing device to be connected with a cabinet cable, and the cabinet cable is connected with a power source of the refrigerating and freezing device, thus realizing the power supply to the control board 170 and power supply to electronic components in the door body 210.

So far, those skilled in the art should be aware that, although plural exemplary embodiments of the present invention have been shown and described herein in detail, a lot of other variations or modifications conforming to the principle of the present invention can still be directly determined or derived from the contents disclosed in the present invention without departing from the spirit and scope of the present invention. Therefore, the scope of the present invention should be understood and deemed as covering all of these other variations or modifications.

What is claimed is:

1. A clip assembly arranged in a refrigerating and freezing device, the clip assembly comprising:

a fixed member used for fixing to the refrigerating and freezing device; and clips, a clip storage box, and a movable member, wherein the clip storage box has a storage cavity used for storing the clips, the movable member has an accommodating space that accommodates the clip storage box, the clip storage box is detachably accommodated in the accommodating space, and the movable member is configured to operably rotate to a side away from the fixed member, such that the clip storage box can be taken out for cleaning, wherein the fixed member comprises a fixed vertical plate and two fixed side plates extending backwards from two sides of the fixed vertical plate in a length direction thereof respectively, and each of the fixed side plates is provided with a slide way and a rotary shaft hole;

the movable member comprises a movable vertical plate and two movable side plates extending backwards from two sides of the movable vertical plate in a length direction thereof respectively, and each of the movable side plates is provided with a positioning shaft fitted with the slide way and a rotary shaft fitted with the rotary shaft hole; and the movable member is configured to rotate with the rotary shaft as an axis when operably rotating to the side away from the fixed member, and the positioning shaft moves along the slide way, wherein the movable member further comprises a bottom plate extending backwards from a lower end of the movable vertical plate, and a rear vertical plate located on a rear side of the movable vertical plate, and the movable vertical plate, the bottom plate, the two movable side plates, and the rear vertical plate define the accommodating space; and the rear vertical plate is clamped to the bottom plate and the two movable side plates, wherein the clip assembly further comprises an antenna board cover having a vertical plate cover located between the fixed vertical plate and the movable vertical plate and a lower mounting plate extending backwards from a lower end of the vertical plate cover to a position below the bottom plate of the movable member;

chips in one-to-one correspondence with the clips, the chips having food information, and the chips being configured to be operably taken out;

an antenna board arranged on the vertical plate cover and located on a rear side of the vertical plate cover; and a control board arranged on the lower mounting plate and covered with the bottom plate, the control board being configured to read the food information on the chips through the antenna board.

2. The clip assembly according to claim 1, wherein each of the movable side plates is further provided with an opening and a flexible limiting member located in the opening, and the flexible limiting member has a fixed part connected to an upper end of the opening and a free part extending downwards from the fixed part; and a limiting fitting member is formed at a position of the clip storage box corresponding to the flexible limiting member, the flexible limiting member is exposed after the movable member rotates to the side away from the fixed member, and the free part of the flexible limiting member operably moves away from the limiting fitting member to be separated from the limiting fitting member, such that the clip storage box is operably taken out.

3. The clip assembly according to claim 1, wherein an upper flange smoothly bent and extending forwards and upwards is formed at an upper end of the movable vertical plate, a first positioning plate extending along the length direction of the upper flange and extending backwards is formed on a rear side of the upper flange, and the first positioning plate is located above the movable vertical plate and spaced apart from the upper end of the movable vertical plate;

a second positioning plate extending along the length direction of the rear vertical plate and extending forwards is formed on a front side surface of the rear vertical plate;

the first positioning plate is provided with a plurality of first positioning holes distributed at intervals along the length direction of the first positioning plate, and the second positioning plate is provided with a plurality of second positioning holes distributed at intervals along the length direction of the second positioning plate; and the clip storage box comprises a box body, a front flange extending forwards from a front edge of an upper end portion of the box body, and a rear flange extending backwards from a rear edge of the upper end portion of the box body, a plurality of first positioning parts which extend downwards and are in one-to-one correspondence with and fitted with the plurality of first positioning holes are formed on a lower side of the front flange, and a plurality of second positioning parts which extend downwards and are in one-to-one correspondence with and fitted with the plurality of second positioning holes are formed on a lower side of the rear flange.

4. The clip assembly according to claim 1, wherein a lower flange extending downwards is formed on a rear side of the bottom plate, a side flange extending outwards along the length direction of the movable side plate is formed on a rear side of each movable side plate, a plurality of first clamping holes distributed at intervals along the length direction of the lower flange are formed in the lower flange, and a second clamping hole is formed in a lower end of the side flange; and the rear vertical plate is provided with a plurality of first buckles in one-to-one correspondence with the plurality of first clamping holes and clamped thereto, and a second buckle clamped to the second clamping hole.

5. The clip assembly according to claim 4, wherein a first positioning groove is formed in an upper end of the side flange, and a positioning strip located between the first positioning groove and the second clamping hole and protruding backwards is further formed on the side flange; and the rear vertical plate is further provided with a positioning post fitted with the first positioning groove and extending forwards, and a second positioning groove fitted with the positioning strip.

6. The clip assembly according to claim 1, wherein the number of the clips is multiple, the number of the chips is multiple, the chips are in one-to-one correspondence with the clips, and the food information contained in the chips is different; and the clip storage box has a plurality of storage cavities in one-to-one correspondence with the clips, a clip taking opening is formed in an upper end of each storage cavity, and the clips are inserted into the corresponding storage cavities or extracted from the corresponding storage cavities through the clip taking openings.

7. The clip assembly according to claim 1, wherein a plurality of first clamping hooks distributed at intervals in the length direction of the vertical plate cover are formed on a rear side of an upper end portion of the vertical plate cover, a plurality of second clamping hooks distributed at intervals in the length direction of the vertical plate cover are formed on a rear side of a lower end portion of the vertical plate cover, and the plurality of second clamping hooks have the same number as the plurality of first clamping hooks and are in one-to-one correspondence with the plurality of first clamping hooks;

the antenna board is clamped between the plurality of first clamping hooks and the plurality of second clamping hooks;

a first clamping protrusion protruding backwards is formed on a rear side surface of the antenna board, and a first clamping groove fitted with the first clamping protrusion is formed in a front side surface of the movable vertical plate; and a plurality of second clamping grooves distributed at intervals along the length direction of the vertical plate cover are formed in an upper side of the upper end portion of the vertical plate cover, and a plurality of second clamping protrusions which are in one-to-one correspondence with the plurality of second clamping grooves and clamped thereto are further formed on the front side surface of the movable vertical plate.

8. A refrigerating and freezing device, comprising:

a door body; and the clip assembly according to claim 1, wherein the fixed member of the clip assembly is connected to an inner side of the door body.

* * * * *